United States Patent [19]

Cotic

[11] 4,283,817

[45] Aug. 18, 1981

[54] METHOD FOR BONDING ELECTRODE PLATES IN A MULTICELL X-RAY DETECTOR

[75] Inventor: Dennis J. Cotic, Milwaukee, Wis.

[73] Assignee: General Electric Company, Milwaukee, Wis.

[21] Appl. No.: 971,202

[22] Filed: Dec. 20, 1978

[51] Int. Cl.[3] ..... H01J 1/88

[52] U.S. Cl. ..... 29/25.16; 156/293; 156/305

[58] Field of Search ..... 29/25.16; 156/305, 293

[56] References Cited

U.S. PATENT DOCUMENTS

| | | | |
|---|---|---|---|
| 4,119,853 | 10/1978 | Shelley et al. | 250/385 |
| 4,137,117 | 1/1979 | Jones | 156/305 |

*Primary Examiner*—John McQuade

*Attorney, Agent, or Firm*—Douglas E. Stoner; Dana F. Bigelow

[57] ABSTRACT

A multicell x-ray detector includes a chamber for confining a gas that produces electron-ion pairs incidental to absorbing radiation. A unitary multicell electrode assembly is mounted within the chamber. The assembly includes a plurality of electrode plates secured in first and second insulating members. A method is provided for bonding the electrode plates into the insulating members with a uniform distribution of adhesive which does not allow the adhesive to bridge between adjacent plates. The opposed ends of the plurality of electrode plates are inserted into grooves of the members. A relatively non-viscous liquid adhesive is brought into contact with one edge of each of the grooves of both members by a cellular applicator until the adhesive propagates by capillary action along the entire length of each groove. The cellular applicator and the adhesive are such that the adhesive has a greater adhesive attraction to the applicator than to the adjacent plates, and such that the adhesive has a lesser adhesive attraction to the applicator than to the grooves of the members. The adhesive will therefore flow from the applicator to the grooves of each member until each groove is filled and any excessive adhesive will be attracted back to the applicator, rather than to the adjacent plates of the assembly. The adhesive is then cured.

7 Claims, 8 Drawing Figures

METHOD FOR BONDING ELECTRODE PLATES IN A MULTICELL X-RAY DETECTOR

BACKGROUND OF THE INVENTION

This invention relates to detectors for ionizing radiation, such as x-ray and gamma radiation. The invention is concerned with improving multicell detectors by minimizing thermal and microphonic instabilities of the detectors.

The detectors have various uses but are especially useful in x-ray computed axial tomography systems. In the computed axial tomography process, a spatial distribution of x-ray photon intensities merging from a body under examination are translated into analog electric signals which are processed in a manner that enables reconstructing the x-ray image and displaying it as a visible image. Background information on the process is given in an article by Gordon, et al., "Image Reconstruction from Projections", Scientific American, October, 1975, Vol. 233, No. 4.

In computed axial tomography systems, detectors must detect x-ray photons efficiently and with a high degree of spatial resolution. In some systems, the x-ray source is pulsed and the pulsed repetition rate can be limited by the recovery time of the x-ray detectors. It is desirable to use x-ray detectors which have fast recovery time, high sensitivity, and fine spatial resolution. In multicell detectors, it is also important for each cell to have identical and stable detecting characteristics.

In some tomography systems, the x-ray bean is fan-shaped and diverges as it exits from the examination subject whereupon the beam falls on the array of detector cells such that photon intensities over the leading front of the beam can be detected and resolved spatially. As the x-ray source and detector oribts around the examination subject jointly, the x-ray intensities across the diverging beam projected from the source are detected by the individual detector cells and corresponding analog electric signals are produced. The individual detector cells are arranged in a stack or array so that the x-ray photon distribution across the beam at any instant are detected simultaneously. The signals correspond with x-ray absorption along each ray path at the instant of detection. Additional sets of signals are obtained for the several angular positions of the orbiting detector and x-ray source. The discrete analog signals are converted to digital signals and are processed in a computer which is controlled by a suitable algorithm to produce signals representative of the absorption by each small volume element in the examination subject through which the fan-shaped x-ray beam passes.

To get good spatial resolution, it is desirable to have the electrode plates, which comprise each cell, spaced closely and uniformly over the entire length of the detector. A detector which has advanced achievement of these results is disclosed in U.S. Pat. No. 4,119,853, entitled "Multicell X-ray Detector" to Shelley, et al., and is assigned to the assignee of the present application. The detector in the cited patent comprises a plurality of adjacent, but slightly spaced apart, electrode plates standing edgewise so as to define gas filled gaps between them in which ionization events, that is, the production of the electron-ion pairs due to photon interaction with the gas, may take place. Improved spacing and dimensional tolerances are achieved by securing the electrode plates in a unitary electrode assembly. The structure of the cited detector comprises a pair of flat metal bars which are curved in their planes and constitute a segment of a circle to form the upper and lower frame for the assembly. The bars are substantially congruent with each other in spaced apart parallel planes. There are spacers between the ends of the bars to maintain their spacing. Similarly, curved insulating members which support the electrode plates are bonded to the facing sides of the respective bars. The insulating members have circumferentially spaced radially extending grooves machined in them. Grooves in opposite members lie on the same radii. A viscous resin coating, such as an epoxy resin, is spread over the entire grooved face of each member. The upper and lower edges of an array and electrode plates are inserted in corresponding grooves in the respective insulating members. An epoxy interface is formed between the upper and lower edges of the electrode plates and the walls of the slots. The bonding method also result in bridges of epoxy being developed between the adjacent electrode plates as shown in FIGS. 1 and 1*a*. The epoxy resin is cured to produce a solid bond of each plate. Alternate electrode plates are connected together and then connected to a common potential source and are called the bias electrodes. The signal electrodes, constituting the electrode plates intervening between every other bias electrode plate, have their own individual connections leading to a data signal acquisition system, which is exterior of the detector. The unitary electrode assembly is disposed within a pressure vessel or chamber which has an internal channel that is curved complimentarily with the electrode assembly. The front wall of the chamber has a relatively thin section, constituting an x-ray transmissive window. A cover is secured to the chamber to close the open top of the channel, and a sealing gasket is disposed between the cover and the chamber. Means are provided for pressurizing the interior of the chamber with a high atomic weight gas, such as xenon, at about 25 atmospheres to adapt the detector for use with x-rays adding photon energy in the range of up to 120 kilo electron volts.

A common problem associated with the detector of the prior art results from high frequency mechanical vibration and is known as microphonics. The electrode plates are made of extremely thin metal and must operate in close proximity with a relatively large potential difference between them. Mechanical vibrations can be transmitted through the gas chamber to the electrode assembly and to the electrode plates. Such vibrations may significantly vary the capacitance between electrodes, particularly where the plates have differing rigidity, and can introduce microphonic current changes, which cause errors in the x-ray intensity measurements. These spurious microphonic currents are in the picoampere range, but are comparable to the x-ray induced signal and have been erroneously measured as signals in prior art detectors even though no x-ray photons were present.

Another common problem associated with the detector of the prior art results from low frequency distortions due to thermal variations of the electrode assembly over the operating range of the detector. The thermal expansion can create relative distortion between the electrode plates to significantly vary the spacing between the electrodes and introduce microphonic currents and inconsistent responses which may cause errors in the x-ray intensity measurements.

A particular problem is presented by the prior art method of bonding the electrode plates to the members. It was previously believed that the bridges of epoxy which were formed by capillary action between the plates were beneficial to stabilize the plates. It was recently discovered that not only is the excessive epoxy not beneficial, it significantly contributes to microphonics by making some plates more rigid than others, and to thermal instability due to the different coefficients of expansion of the plates and the epoxy which distorts the cells spacing at different operating temperatures of the detector.

SUMMARY OF THE INVENTION

An object of the present invention is to overcome the above noted disadvantages and to provide a multicell x-ray detector that does not exhibit spurious signal currents due to microphonics.

Another object of the invention is to provide a multicell x-ray detector which maintains its specific characteristics despite substantial thermal variations.

A feature of the present invention is to provide a method for bonding each plate to the insulating members with a uniform distribution of adhesive.

Another feature of the invention is to provide a method for bonding the electrode plates to the insulating members which prevents the adhesive from wicking between adjacent plates by capillary action.

A multicell x-ray detector includes a chamber for confining a gas that produces electron-ion pairs incidental to absorbing radiation. A unitary multicell electrode assembly is mounted within the chamber. The assembly includes a plurality of electrode plates secured in juxtaposed spaced apart relationship by having one pair of opposed edges of the plates engaged in corresponding grooves in a first and second insulating member. The plates also have front edges and spaces between the plates, constituting cells for being occupied by the gas. Electric circuits are provided from the plates of the unitary electrode assembly to the exterior of the chamber.

In accordance with the present invention, a method is provided for bonding the electrode plates into the insulating members with a uniform distribution of adhesive which does not allow the adhesive to bridge between adjacent plates. The first and second members are positioned in spaced apart relationship having their grooved sides to face each other. The opposed ends of the plurality of electrode plates are inserted into the corresponding grooves of the members. A relatively non-viscous liquid adhesive is brought into contact with one edge of each of the grooves of both members until the adhesive flows by capillary action along the entire length of each groove. In one embodiment, the adhesive is applied by a cellular applicator which is saturated with the adhesive. The cellular applicator and the non-viscous liquid adhesive are such that the adhesive has a greater adhesive attraction to the applicator than to the adjacent plates, and such that the adhesive has a lesser adhesive attraction to the applicator than to the grooves of the members. The adhesive will therefore flow from the applicator to the greater adhesive attraction of the grooves of each member until each groove is filled with adhesive. Once the groove is filled, the adhesive attraction is balanced and any excessive adhesive will be attracted back to the applicator, rather than to the adjacent plates of the assembly. The adhesive is then cured, thereby securing the electrode plates into the insulating members of the radiation detector.

BRIEF DESCRIPTION OF THE DRAWINGS

While the novel features of the invention are set forth with particularity in the appended claims, the invention will be better understood, along with other features thereof, from the following detailed description taken in conjunction with the drawings in which:

DESCRIPTION OF THE PREFERRED EMBODIMENT

Figure 2:
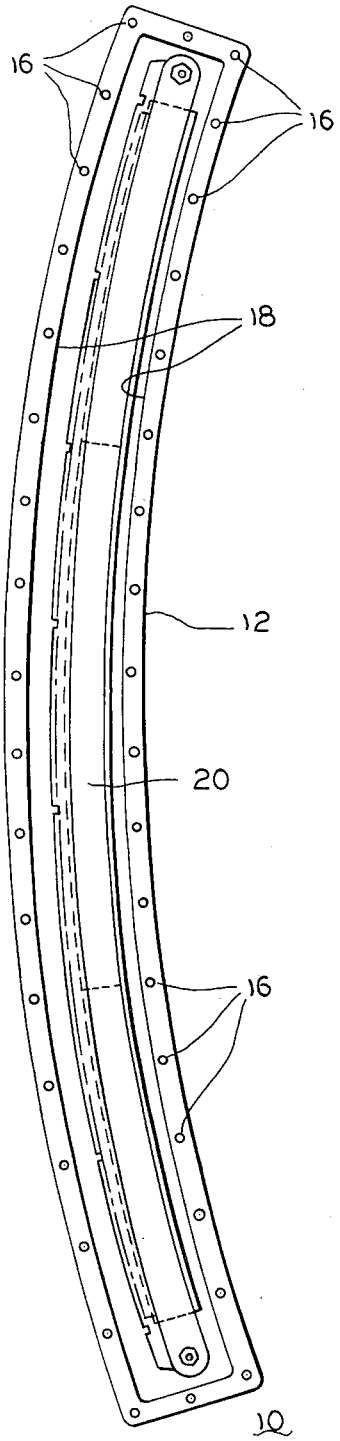
FIG. 2 is a plan view of the multicell electrode assembly, with the chamber for the ionizing gas shown as a dashed line around the electrode assembly.

Referring to FIG. 2, there is shown the front elevation of the multicell detector 10 commonly used in computed axial tomography systems. The width of the detector is usually about the same as the width of the x-ray beam whose differential photon intensities are to be detected. The curvature of the detector generally corresponds to a radius equi-distant from the x-ray source (not shown) of the system. However, the detector can also function in a substantially straight configuration and may be used in any physical orientation. The multicell detector comprises a body or chamber 12 (shown with the cover removed). The cover is secured to the body with a plurality of cap screws in threaded apertures 16. In a commercial embodiment, chamber 12 is a single piece of aluminum in which a curved channel is machined. The curved channel is shown by the dashed line marked 18. The curved front wall of chamber 12 has an elongated recess milled in it. This provides a relatively thin front wall section that serves as an x-ray permeable window which is thin enough to absorb little of the high energy photons at the energies used in computed tomograhy, the window is thick enough to resist the high gas pressure which exists in the chamber. A suitable fitting is installed into one end of the chamber 12 for enabling the interior of the chamber to be evacuated and for filling it with ionizable gas. A unitary multicell electrode assembly 20 is shown in solid lines positioned within the curved channel 18 of chamber 12.

A detailed description of the operation of the multicell x-ray detector, as well as the detailed description of each of the components of the detector is fully described in U.S. Pat. No. 4,119,853, entitled "Multicell X-ray Detector" to Shelley, et al., and is incorporated herein by reference.

Figure 3:
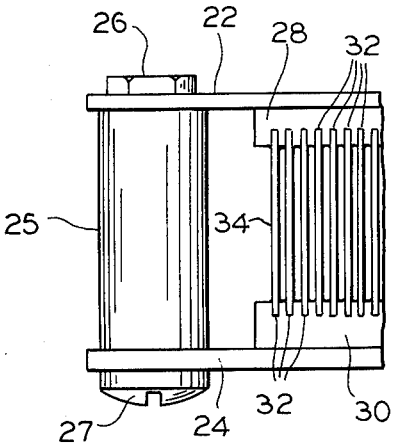
FIG. 3 is a front elevation view similar to FIG. 1 showing the adhesive bonding of the present invention.
Figure 3A:
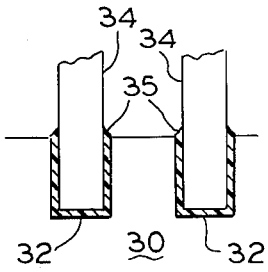
FIG. 3A is an enlarged detail of adjacent cells of the electrode assembly on FIG. 3.

The multicell electrode assembly 20 is shown in FIGS. 2 and 3. In general terms, the detector assembly 20 comprises a pair of flat metal bars 22 and 24 which are curved in their planes and constitute a segment of a circle. The bars are disposed substantially congruently with each other in spaced apart parallel planes. There are spacers 25 between the ends of the bars to maintain their spacing. The spacers 25 each have an axial internally threaded hole for receiving the stem of a cap screw 26 for clamping top bar 22 to the spacer. Spacers 25 also have an axial internally threaded hole for receiving the stem of a round headed machine screw 27. The metal bars and spacers constitute a frame for the assembly 20. The frame retains an upper insulating member 28 of a suitable insulating material which in this embodiment is a curved bar of ceramic. There is also a similarly curved lower ceramic member 30. Each of the ceramic members has corresponding radial grooves 32 milled into the inner face. The radial grooves 32 are adapted to receive a plurality of juxtaposed, circumferentially spaced apart and radially directed electrode plates 34 along substantially the entire length of the detector 10. Every alternate electrode plate is connected together by a common wire spot-welded to each plate. These alternate electrode plates, which are connected in common, have a high bias voltage applied to them during operation and are called the bias electrodes. The electrodes between each bias electrode are referred to as signal electrode plates. During operation, discrete electric current signals are taken from each of the signal electrode plates. Each of the signal electrode plates has its own lead wire which is extended upward from each plate and passes upward to a printed circuit board (not shown) which provides a circuit to the exterior of the chamber. The printed circuit board is described in detail in co-pending application Ser. No. 855,532, entitled "Printed Circuit Board of High Resolution Detector", to Cotic, et al., now Pat. No. 4,161,655, and is assigned to the assignee of the present application.

The thin electrode plates 34 are preferably made of stiff high atomic number metal having high x-ray absorption, thus avoiding permeation of x-radiation from one gas filled cell to another, called "crosstalk" which degrades spatial resolution of the detector. The metal plates are matched with other metals having appropriate thermal coefficents of expansion to avoid uneven expansion and distortion that might result from temperature changes of the electrode assembly. Tungsten, tantalum or alloys of tantalum and tungsten are desirable metals for the electrode plates because of their stiffness and high atomic number, but other high atomic number metals may also be used. For the sake of thermal matching, spacers 25 are molybdenum, with electrode plates of tungsten or tantalum and the curved support bars for the ceramic insulating members are made of stainless steel in the 416 series.

Typical of high resolution illustrated embodiment, enough plates are used to create 500 ionizing cells which comprise the gas filled spaces bound by adjacent pairs of electrodes, comprising a signal electrode and a bias electrode. The electrode plates are tungsten 6 mils (0.006 in.) thick. The radial grooves 32 in ceramic members 28 and 30 are 7 mils wide, 40 mils deep and arranged so there are 18 mils separating each plate. Increasing the number of active ionization cells results in increased capability of the detector to resolve discrete x-ray absorption information which results in higher resolution and defintion in the visual image that is produced by computed image reconstruction. The upper and lower edge of each electrode plate 34 is securely bonded into each of the corresponding grooves 32 of the insulating members 28 and 30.

Figure 1:
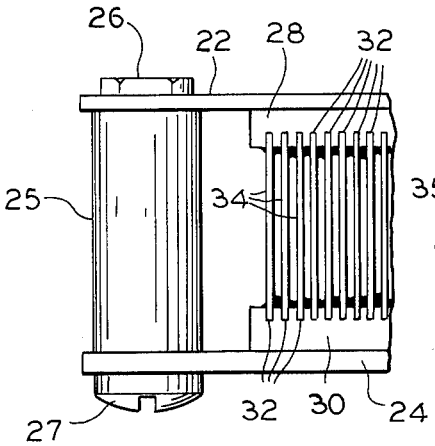
FIG. 1 PRIOR ART
FIG. 1 is a front elevation view of the electrode assembly of the prior art showing particularly the adhesive bridges between adjacent electrode plates.
Figure 1A:
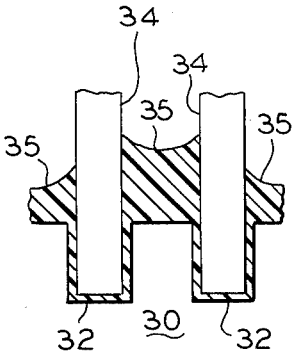
FIG. 1A is an enlarged detail of the adjacent plates of FIG. 1.

The detector in the referenced patent to Shelley, et al., as shown in FIGS. 1 and 1A, bonded the plates to the insulating members by first coating the grooved face of the insulating members with a viscous resin coating 35, such an epoxy. As previously discussed, this method posed several problems in the assembly and operation of the electrode assembly. Once the assembler has coated the insulating members, he must rapidly insert all the electrode plates 34 before the epoxy solidifies. The insertion of the approximately 1,000 plates can require up to 6 hours for installation and the adhesive can become fairly rigid over that time period. A significant disadvantage is that by the time all of the plates are installed the assembly is fairly rigid and there is very little opportunity to inspect or replace defective plates. Also, as each plate is inserted into its respective groove, the plate forces the adhesive out of the groove and toward the back of the insulating member. The excessive adhesive bridges between adjacent plates by surface energy phenomenon, commonly known as capillary action. Although the bridged adhesive tends to rigidize the plates into the insulating members, the amount of bridging is not uniform and therefore some of the plates are more rigid than others. In addition, the adhesive material has a different coefficient of expansion than does the electrode plates and with changes in temperature, this difference in expansion causes a difference in the cell spacing which effects the response by the detector. This invention departs from the referenced patent to Shelley, et al., in the method that the electrode plates are bonded into the insulating members.

In accordance with the present invention, the surface energy phenomenon was recognized and, with proper control, would be a unique method of applying the adhesive to the plate and groove interface. Any liquid will flow until the cohesive attraction of the liquid exceeds the adhesive attraction of the liquid for adjacent surfaces. Where the liquid engages two adjacent surfaces having close spacing and sufficient adhesive attraction, the liquid will propagate between the surfaces until it reaches equilibrium. Surface energy pheonomenon is a function of the adhesive and cohesive properties of liquids in contact with other surfaces and is discussed in detail in a book entitled *Elementary Fluid Mechanics,* by John K. Vennard, Wiley Press, 3rd Edition, "Viscosity, Surface Tension and Capillarity", pp. 11–17.

Figure 4:
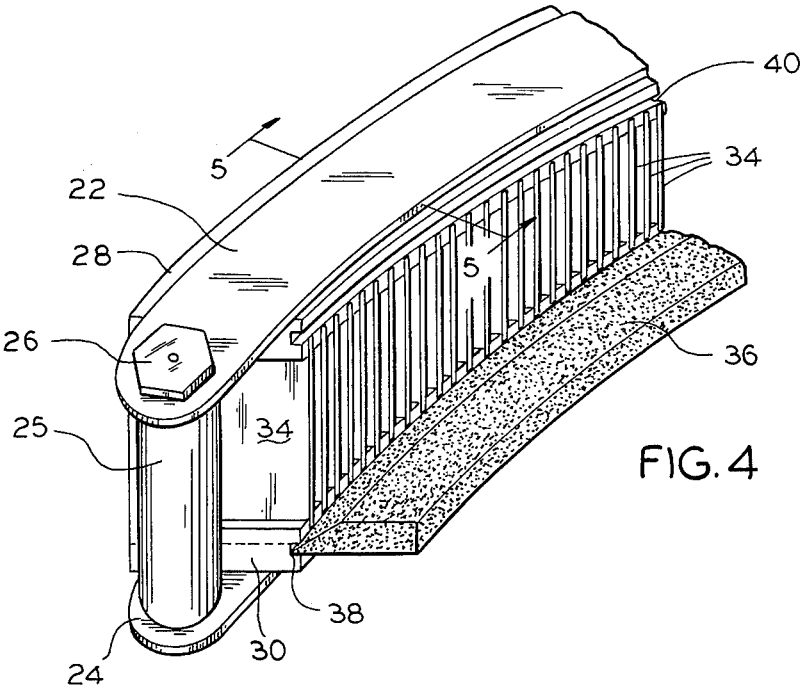
FIG. 4 is a perspective view of the multicell electrode assembly with an adhesive application applying adhesive to an insulating member.
Figure 5:
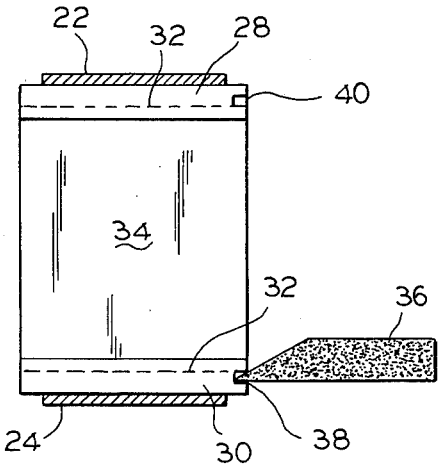
FIG. 5 is a sectional view taken along line 5—5 of FIG. 4.

Referring now to FIGS. 4 and 5, the bonding method can be fully described. The first and second insulating members 28 and 30 are positioned in spaced apart relationship by spacer 25 and having their grooves 32 face each other. A fixture (not shown) can be used which tilts the members approximately 45° away from the assembler to facilitate insertion of the electrode plates. The fixture includes a rear member for registering the front to back location of each plate. The electrode plates 34 are inserted into the corresponding grooves 32 of the members. After insertion of the plates 34, each cell is inspected with a photocomparator to assure that all of the plate spacings are within tolerance. Any distorted or defective plates can be readily detected and replaced at this time to assure that the detector will perform properly on final assembly.

With all of the electrodes 34 properly positioned with the grooves 32 of the insulating members, the adhesive can now be applied to the assembly. A suitable adhesive is comprised of Shell 825 epoxy, (100 parts by weight) and Hysol 3561 hardner, (31 parts by weight), with a percentage of Butyl Glycidyl Ether (BGE) used to dilute the adhesive to decrease the viscosity. The lower the viscosity, the more rapidly the adhesive will propagate across the length of the grooves. It has been found that an approximate 12% solution of BGE results in an adhesive having a viscosity of approximately 200 centipoise, which flows across the length of the plate and groove in approximately 5 minutes. Another adhesive which is readily applied by the capillary bonding method is Conap 1163 urethane adhesive. A variety of other relatively nonviscous liquid adhesives (viscosity of approximately 200 centipoise or less) would be suitable for this technique of bonding any thin plates to any slotted member. The adhesive is applied to the insulating members at one edge of each of the grooves until the adhesive propagates along the length of each groove by surface energy phenomenon (capillary action). A sponge-like cellular applicator 36 is saturated with the adhesive to act as a reservoir of adhesive and is abutted against the grooved edge of the member. An elongated cavity 38, which communicates with each groove 32 of the bottom member 30, is provided to facilitate the installation of the applicator against the grooves. A similar elongated cavity 40 is provided for member 28. The elongated cavities 38 and 40 are not essential to the method, but do facilitate the manufacture of the electrode assemblies. The relative adhesive attraction of the adhesive to the grooves and to the adjacent plates and to the applicator is extremely important in controlling the uniformity of the adhesive at the plate and groove interface. The cellular applicator 36 is selected to which the adhesive has a greater adhesive attraction than to the adjacent plates, and to which the adhesive has a lesser adhesive attraction than to the grooves of the members. A suitable sponge material which exhibits the above properties has an open cell structure of approximately 80 hollow spherical type bubbles per linear inch of material. However, a variety of application materials which are compatible with a given adhesive would be equally suitable to control the reservoir of adhesive.

It is readily seen that when the applicator 36, which is soaked with adhesive, is brought into contact with the grooved edges of the members, the very narrow spaces between the grooves 32 and the electrode plates 34 will provide a very positive adhesive attraction for the adhesive, and the adhesive will therefore be drawn by capillary action from the applicator 36 into the interface of the grooves. This surface energy phenomenon will continue until the adhesive propagates along the entire length of each groove, at which time the grooves will be filled and the surface energies will be in equilibrium and the capillary action will cease. With the adhesive attraction of the grooves in equilibrium, the adhesive will next flow toward the material presently having the greatest adhesive attraction, which is the applicator 36. As long as there is capacity in the applicator 36 to absorb adhesive, the adhesive will not bridge between adjacent alternate plates 34. This assures that the adhesive will be uniformly and evenly distributed along the electrode plate and insulating member interface and will not bridge between adjacent plates. The applicator 36 can be of a size equivalent to that of the length of the detector which will apply adhesive to all of the grooves of the members simultaneously or can be a smaller applicator which will apply adhesive in segments along the length of the insulating member. The applicator 36 is similarly applied to cavity 40 to uniformly apply adhesive to the opposite ends of the plate at the grooves of insulating member 28.

With the slots 32 in a generally horizontal orientation and with the plates 34 in a generally vertical orientation, the electrode assembly is cured to securely bond the electrode plates into the insulating members. With the epoxy of this preferred embodiment, the curing time is accelerated by heating the assembly at an approximate temperature of 50° C. for approximately 4 hours. The curing is, of course, a function of the type of adhesive used in the bonding method. Anerobic adhesives are cured by the absence of oxygen; urethanes are cured by the presence of moisture in the air; and cyanoacrylate is cured by the presence of moisture and pressure. In alternate methods of bonding, it may be necessary to apply the adhesive to one edge and cure the adhesive and then reverse the assembly and bond the other edge of the plates to the other member. This may be necessary for bonding where gravity adversely effects the upper interface.

Figure 6:
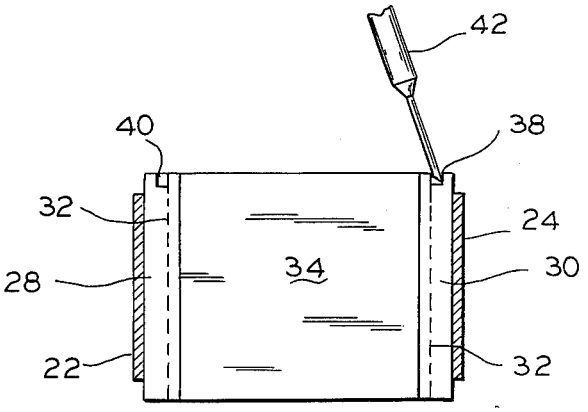
FIG. 6 is a side elevation view of an electrode assembly incorporating another embodiment of the present invention.

Referring now to FIG. 6, there is shown another method of applying the adhesive to the plate and groove interface. The plates 34 are inserted into the grooves 32, as described in the previous method. The insulating members are oriented so that the elongated cavities 38 and 40 are in the upright horizontal position. An applicator 42, such as a hypodermic needle, is used to deposit the liquid adhesive into the elongated cavities 38 and 40. The cavities act as a reservoir for the adhesive which is evenly distributed along the upper edge of the member. The elongated cavities 38 and 40 are sized so that the adhesive has a greater adhesive attraction for the cavity than the adhesive attraction to the adjacent plates, and also so that the adhesive has a lesser adhesive attraction to the cavity than the adhesive attraction to the grooves of the members. Therefore, the adhesive propagates along each of the grooves 32 to uniformly coat the interface of the plates with each respective groove without bridging between adjacent plates. Gravity plays a very minor role in the surface energy phenomenon and the propagation is essentially that of the relative adhesive attraction to the members. However, once the grooves are all filled, the electrode assembly is repositioned so that the grooves are in the horizontal orientation for curing. The adhesive is then cured as required for the particular type of adhesive used to complete the bond of the plates into the electrode assembly.

An important feature of the surface energy method for bonding the plates into the insulating members is that it greatly facilitates the assembly and manufacturability of the detector. It is much easier for the assembler to install the electrode plates into the insulating members while the members are dry as compared to when they are coated with very viscous epoxy resins. It also enables the assembler to very thoroughly inspect each cell of the electrode assembly and readily replace any defective plates, which precludes extensive rework and, in some cases, scrapping of a complete detector assembly because of a defective cell.

Another important feature of this method of bonding the electrode plates into the insulating members is the uniformity of the adhesive at the interface of each groove with no bridging of the adhesive between adjacent electrode plates. As previously described, this reduces the ill effects of microphonics, thermal distortions, and non uniform responses by the detector.

While specific embodiments of the present invention have been illustrated and described herein, it is realized that modifications and changes will occur to those skilled in the art. It is, therefore, to be understood that the appended claims are intended to cover all such modifications and changes as fall within the true spirit and scope of the invention.

What is claimed is:

1. A method for securing a plurality of plates into first and second members each having a side in which there is a plurality of grooves adapted to receive one of the opposed ends of the plates, said method comprising:

positioning the members in spaced apart relationship having their grooved sides facing each other;

inserting the opposed ends of the plates into the corresponding grooves of the members;

applying a relatively non-viscous liquid adhesive into contact with one edge of each of the grooves of both members by saturating a cellular applicator with the adhesive and abutting the applicator against the members until the adhesive flows by capillary action along the length of each groove; and curing the adhesive thereby securing the plates into the members.

2. A method for securing a plurality of plates into first and second members each having a side in which there is a plurality of grooves adapted to receive one of the opposed ends of the plates, said method comprising:

positioning the members in spaced apart relationship having their grooved sides facing each other;

inserting the opposed ends of the plates into the corresponding grooves of the members;

applying a relatively non-viscous liquid adhesive into contact with one edge of each of the grooves of both members by depositing the adhesive into a cavity communicating with each groove of the members and allowing it to flow by capillary action along the length of each groove; and curing the adhesive thereby securing the plates into the members.

3. A method for securing a plurality of generally rectangular electrode plates into first and second insulating members, each member having a side in which there is a plurality of grooves adapted to receive one of the opposed ends of the plates, whereby the installed plates constitute cells for installation into a chamber of gas that produces electron-ion pairs incidental to absorbing radiation, said method comprising:

positioning the first and second members in spaced apart relationship having their grooved sides to face each other;

inserting the opposed ends of the plates into the corresponding grooves of the members;

applying a relatively non-viscous liquid adhesive into contact with one edge of each of the grooves of both members by saturating a cellular applicator with the adhesive and abutting the applicator against the members until the adhesive flows along the length of each groove; and curing the adhesive thereby securing the electrode plates into the insulating member of the radiation detector.

4. A method for securing a plurality of generally rectangular electrode plates into first and second insulating members, each member having a side in which there is a plurality of grooves adapted to receive one of the opposed ends of the plates, whereby the installed plates constitute cells for installation into a chamber of gas that produces electron-ion pairs incidental to absorbing radiation, said method comprising:

positioning the first and second members in spaced apart relationship having their grooved sides to face each other;

inserting the opposed ends of the plates into the corresponding grooves of the members;

applying a relatively non-viscous liquid adhesive into contact with one edge of each of the grooves of both members by depositing the adhesive into a cavity communicating with each groove of the members and allowing it to flow along the length of each groove; and curing the adhesive thereby securing the electrode plates into the insulating member of the radiation detector.

5. The method is recited in claims 1 or 3 wherein the step of applying adhesive includes selecting a cellular applicator to which the adhesive has a greater adhesive attraction than the adhesive attraction to the adjacent plates, and to which the adhesive has a lesser adhesive attraction than to the grooves of the members.

6. The method as recited in claims 2 or 4 wherein the step of applying adhesive includes sizing the cavity so that the adhesive has a greater adhesive attraction for the cavity than the adhesive attraction to the adjacent plates, and so that the adhesive has a lesser adhesive attraction to the cavity than the adhesive attraction to the grooves of the members.

7. The method as set forth in claims 2 or 4 wherein said cavity is positioned generally at a lower gravitational level from said grooves.

* * * * *